US007367849B2

(12) United States Patent
Wang et al.

(10) Patent No.: US 7,367,849 B2
(45) Date of Patent: May 6, 2008

(54) ELECTRICAL CONNECTOR WITH SHORTENED CONTACT AND CROSSTALK COMPENSATION

(75) Inventors: Hung-Lin Wang, Keelung (TW); Chou-Hsing Chen, Keelung (TW); Yung-Cheng Yang, Keelung (TW); Ke-Ping Huang, Keelung (TW)

(73) Assignee: Surtec Industries, Inc. (TW)

( * ) Notice: Subject to any disclaimer, the term of this patent is extended or adjusted under 35 U.S.C. 154(b) by 0 days.

(21) Appl. No.: 11/369,257

(22) Filed: Mar. 7, 2006

(65) Prior Publication Data

US 2007/0212945 A1 Sep. 13, 2007

(51) Int. Cl.
*H01R 24/00* (2006.01)

(52) U.S. Cl. ..... 439/676

(58) Field of Classification Search ..... 439/676, 439/941, 395, 404, 76.1
See application file for complete search history.

(56) References Cited

U.S. PATENT DOCUMENTS

| | | | | |
|---|---|---|---|---|
| 5,228,872 | A | 7/1993 | Liu | |
| 5,580,270 | A | 12/1996 | Pantland et al. | |
| 5,791,943 | A * | 8/1998 | Lo et al. | 439/676 |
| 5,984,713 | A * | 11/1999 | Hsien | 439/418 |
| 5,997,358 | A | 12/1999 | Adriaenssens et al. | |
| 6,010,353 | A | 1/2000 | Ensz | |
| 6,157,542 | A | 12/2000 | Wu | |
| 6,238,231 | B1 | 5/2001 | Chapman et al. | |
| 6,270,381 | B1 | 8/2001 | Adriaenssens et al. | |
| 6,305,950 | B1 * | 10/2001 | Doorhy | 439/76.1 |
| 6,350,158 | B1 | 2/2002 | Arnett et al. | |
| 6,379,157 | B1 * | 4/2002 | Curry et al. | 439/676 |
| 6,429,362 | B1 | 8/2002 | Phommachanh | |
| 6,749,468 | B2 | 6/2004 | Milner et al. | |
| 6,835,101 | B2 * | 12/2004 | Ishikawa et al. | 439/676 |
| 7,112,100 | B2 * | 9/2006 | Ishikawa et al. | 439/676 |
| 7,153,168 | B2 | 12/2006 | Caveney et al. | |
| 2005/0287873 | A1 * | 12/2005 | Carroll et al. | 439/676 |
| 2006/0189215 | A1 * | 8/2006 | Ellis et al. | 439/676 |

* cited by examiner

*Primary Examiner*—Chandrika Prasad
(74) *Attorney, Agent, or Firm*—McGlew and Tuttle, P.C.

(57) ABSTRACT

An electrical connector is provided with a circuit board with interconnecting conductors respectively extending between spring contact termination locations and other termination locations. Sets of spring contact conductors are provided terminating at respective spring contact termination locations. Each of the spring contact conductors of the set of spring contact conductors has a plug contact zone and defines a spring contact conductive path from an associated plug contact zone to a respective spring contact termination location. The sets of spring contact conductors provide different conductive path lengths from an associated plug contact zone to a respective spring contact termination location.

15 Claims, 9 Drawing Sheets

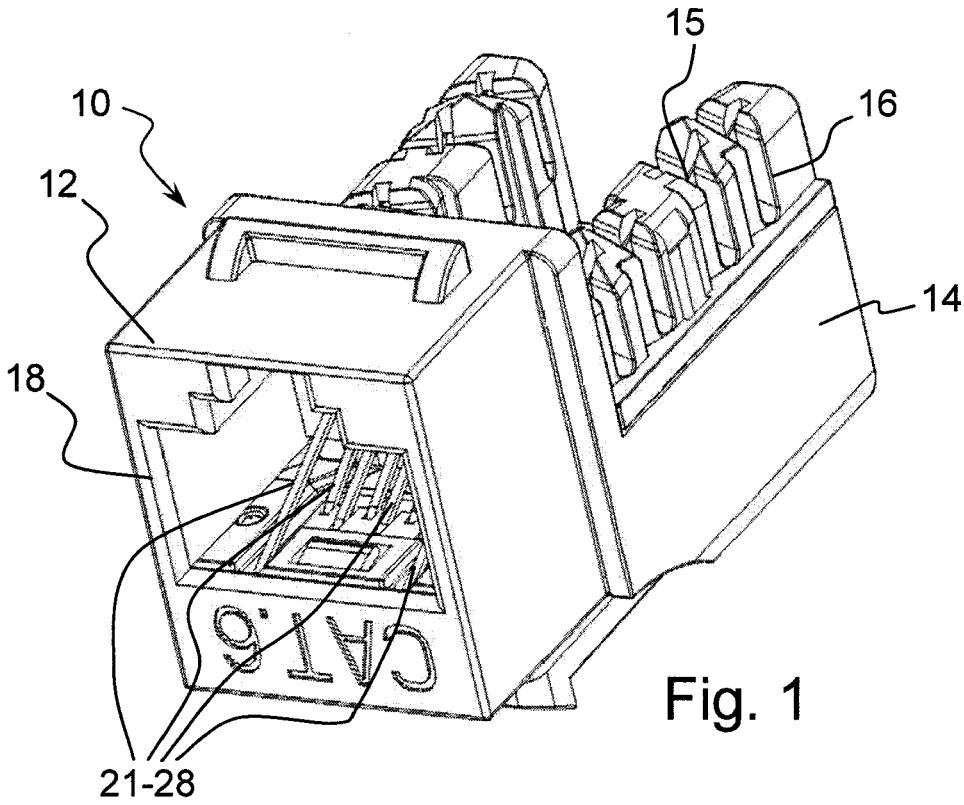
Fig. 1
Fig. 2
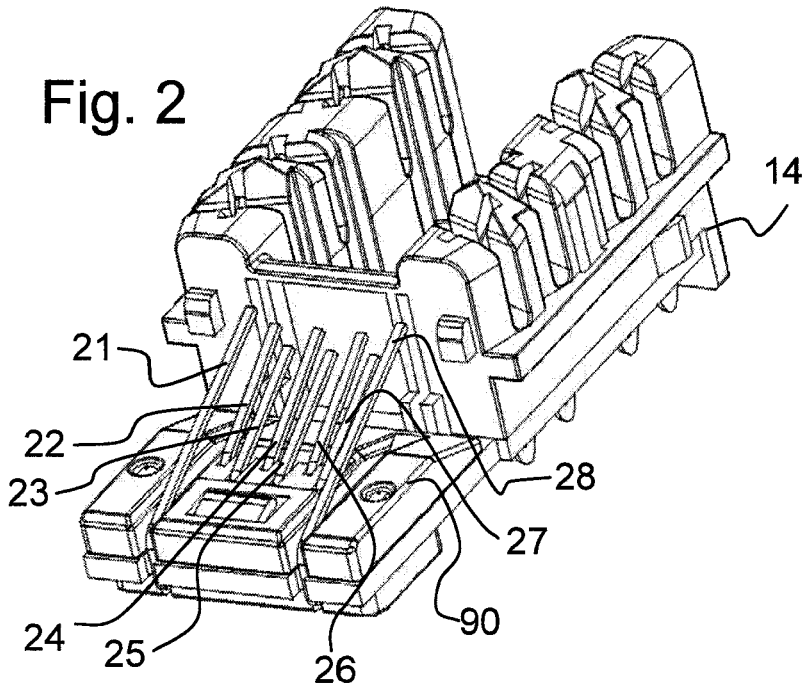

22, 24, 26
70
14.5°
42, 44, 46
4.2 mm
66, 66'

23, 25, 27
70
13.5°
43, 45, 47
5.0 mm
66, 66'

21, 28
70
12.5mm
7.5°
41, 48
PCB
66, 66'
10
12
Contact Point 70
8.4 mm
62

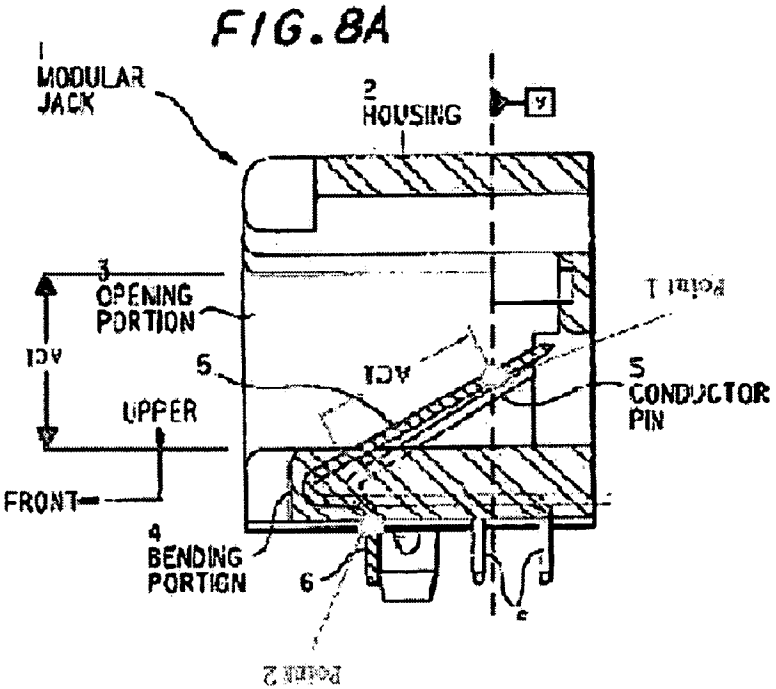
FIG. 8A
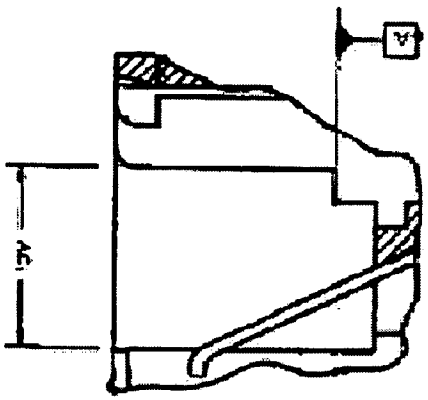
| Lure | Maximum | | Minimum | | Recommended | |
|---|---|---|---|---|---|---|
| | mm | in | mm | in | mm | in |
| $A_1$ | | | | | | |
| $A_2$ | | | | | | |
| $A_3$ | | | | | | |
| $A_4$ | | | | | | |
| $A_5$ | | | | | | |
| $A_6$ | | | | | | |
| $A_7$ | | | | | | |

ELECTRICAL CONNECTOR WITH SHORTENED CONTACT AND CROSSTALK COMPENSATION

FIELD OF THE INVENTION

The present invention relates to electrical connectors such as RJ style plug and jack connectors for communications systems and more particularly to such connectors which attain a high level of throughput transmission performance such as TIA (Telecommunications Industry Association)/EIA (Electronic Industries Alliance) category six performance (CAT 6).

BACKGROUND OF THE INVENTION

The increasing Internet traffic and the increased complexity and use of web applications has forced network providers and network infrastructure managers to seek enhanced transmission speeds for network equipment. The TIA/EIA set up a high-performance cabling category to fulfill this requirement often referred to as CAT 6.

Such high-performance cabling uses a format with RJ 45 jacks and plugs. The agreed to format for the lines at such a connector involves a line with a center pair of conductors at the connector and a split pair of conductors at the connector. One conductor contact of the split pair is on each side of the center pair conductor contacts. When such an RJ45 plug mates with an RJ 45 jack with signals at such high frequencies (as per the standard), the split pair will suffer a significant Near End Cross Talk (NEXT) problem from the other pairs.

It is known that electrical signals of one pair of conductors may be coupled onto the other pair of conductors for compensating or canceling crosstalk. JP 64[1989] 20690 (JP '690) discloses a modular telephone jack with a crosstalk prevention function where a capacitor is installed within a housing. A printed circuit board has traces connected to the capacitors and also connected between insulation displacement contacts (IDCs) and contact springs of the jack. In FIG. 4 an arrangement is shown wherein the traces are used to form a capacitor, to counteract the crosstalk. These traces cross each other with left to right crossing. JP '690 shows both discrete capacitors connected to interconnecting traces of a circuit board to reduce cross talk in jacks as well as traces of the interconnecting traces of the circuit boards providing capacitive interaction to reduce crosstalk.

U.S. Pat. No. 5,997,358 (U.S. '358) discloses an electrical connector that achieves high transmission performance (CAT 6) by providing compensation stages for introducing predetermined amounts of compensation between pairs of conductors. Two or more of such compensation stages are provided. A first compensation stage adds a compensation signal that is time delayed with respect to the other compensation stages. In the first stage, compensating crosstalk is introduced between the pairs of a first predetermined magnitude and phase in a given frequency. In a second stage, compensating crosstalk is introduced between pairs that has a second magnitude and phase at a given frequency. The first stage magnitude is larger than the offending crosstalk and the second stage reintroduces the offending crosstalk. Multiple compensation stages may be used to compensate for a phase issues, because, at high frequencies, compensating crosstalk cannot be introduced that is exactly 180° out of phase with the offending crosstalk.

SUMMARY OF THE INVENTION

It is an object of the invention to provide a connector jack that includes spring contacts with conductor pairs for plural lines defining an RJ style contact interface for connection with an RJ style plug, and with interconnecting circuitry on a printed circuit board, and with crosstalk compensation provided to achieve high levels of throughput.

According to the invention, an electrical connector is provided comprising a circuit board with interconnecting conductors respectively extending between spring contact termination locations and other termination locations. A set of spring contact conductors is provided, each terminating at a respective one of the spring contact termination locations. Each of the spring contact conductors of the set of spring contact conductors has a plug contact zone and defines a spring contact conductive path from an associated plug contact zone to a respective spring contact termination location that is 6.7 mm or less, or even 6.2 mm or less.

An additional set of spring contact conductors may be provided, each terminating at a respective one of the spring contact termination locations. This additional set of spring contact conductors includes a right outside spring contact conductor on a right side of the other set of spring contact conductors and left outside spring contact conductor on a left side of the other set of spring contact conductors. The additional set of spring contact conductors may each have a plug contact zone and define a spring contact conductive path from an associated plug contact zone to a respective spring contact termination location 10 mm or greater. This allows a spring contact (pin) configuration that achieves physical requirements for jack and plug connection.

The spring contact termination locations may be offset with adjacent spring contact termination locations being differently spaced from the plug contact zone, with some of the first set of spring contact conductors having a spring contact conductive path that is from 4.8 mm to 5.2 mm and others of the first set of spring contact conductors having a spring contact conductive path that is from 4.0 mm to 4.4 mm.

The pairs of interconnecting conductors and electrically connected spring contact conductors form part of transmission lines. The connector advantageously further comprises a first/second crosstalk compensation element providing a crosstalk compensation signal between a first interconnecting conductor of one line and a second interconnecting conductor of another line and a second/first crosstalk compensation element providing a crosstalk compensation signal between a second interconnecting conductor of the one line and a first interconnecting conductor of the another line, with each crosstalk compensation element being applied at or closely adjacent to the termination location. The first/second crosstalk compensation element and the second/first crosstalk compensation element may be the only compensation element connected between the first line and the second line on the circuit board. Another crosstalk compensation element may provide a crosstalk compensation signal between an interconnecting conductor of one line and an interconnecting conductor of the second line. The another crosstalk compensation element providing a further crosstalk compensation signal may be applied less than 7.2 mm, or less than 6.7 mm or 6.2 mm, from a termination location of the one line and the second line or at the opposite termination location (IDC termination location).

It is a further object of the invention to provide a connector jack that includes a center spring contact conductor pair (of a first transmission line) and a split pair of spring contact conductors (of a second transmission line), with one conductor-on each side of the center spring contact conductor pair, with the conductors defining an RJ style contact interface and with interconnecting circuitry such as a printed circuit board which is simplified so as to only have a single crosstalk compensation element (providing a compensation signal) for each source of crosstalk, wherein signals carried by the first transmission line and the second transmission line following the compensation elements is no more than −46 dB at 250 MZ.

According to another aspect of the invention an electrical connector jack is provided with a body with a support portion and a plug receiving portion defining an opening with an insertion plane and a circuit board mounted to the support portion to position the circuit board relative to the plug receiving insertion plane. The circuit board has circuit traces respectively extending from the spring contact termination locations. The spring contact termination locations include a first set of spring contact termination locations spaced a first distance from the insertion plane, a second set of spring contact termination locations spaced a second distance from the insertion plane, and a third set of spring contact termination locations spaced a third distance from the insertion plane. A plurality of spring contact conductors, each terminating at a respective one of the spring contact termination locations, are provided having a common plug contact zone. The common plug contact zone is spaced substantially a common distance from the insertion plane.

Each of the spring contact conductors provides a conductive path from the plug contact zone to a respective spring contact termination location. The spring contact conductors connected to the first set of spring contact termination locations and the second set of spring contact termination locations may advantageously have a conductive path that is 7 mm or less, and the spring contact conductors connected to the third set of spring contact termination locations may advantageously have a conductive path that is 7 mm or greater.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a perspective view of a jack assembly according to a first and second embodiment according to the invention;

FIG. 2 is a perspective view showing the jack of FIG. 1 with a jack cover part removed;

DESCRIPTION OF THE PREFERRED EMBODIMENTS

Figure 3B:
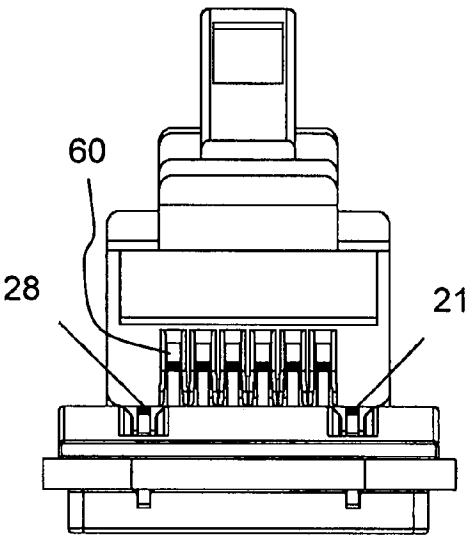
FIG. 3B is a sectional end view showing the jack assembly of FIG. 1 taken through a six contact RJ plug in a mated position.

Referring to the drawings in particular, FIG. 1 shows a jack assembly generally designated 10. The jack assembly 10 may be provided in one of several embodiments as discussed below. The difference between the different embodiments relates to different circuit board embodiments, as discussed below. Otherwise, each embodiment of the jack assembly includes a support portion or jack basic plastic part 14 and a plug receiving portion or jack plastic cover part 12. The plastic basic part 14 includes slots 16 for receiving wires such that they may electrically engage (terminate) with insulation displacement contacts 15. The jack plastic cover part 12 includes a plug opening 18 providing an RJ style interface with positioned spring contact conductors 21-28. The jack assembly 10 may be used individually or may be mounted in a bank with other similar jacks to provide a patch panel.

Figure 3A:
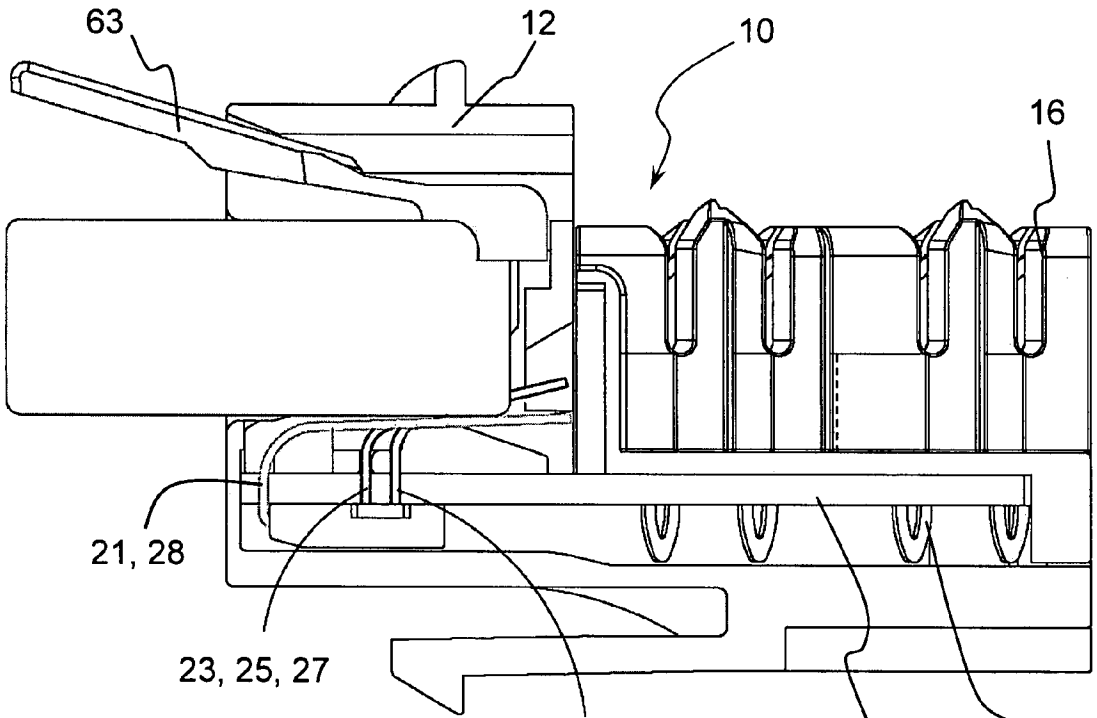
FIG. 3A is a partially sectional side view showing the jack assembly of FIG. 1 mated with a six contact RJ plug.
Figure 3D:
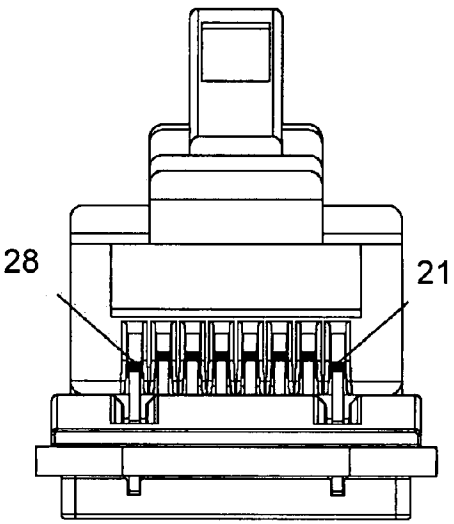
FIG. 3D is a sectional end view showing the jack assembly of FIG. 1 taken through an eight contact RJ plug in a mated position.
Figure 3C:
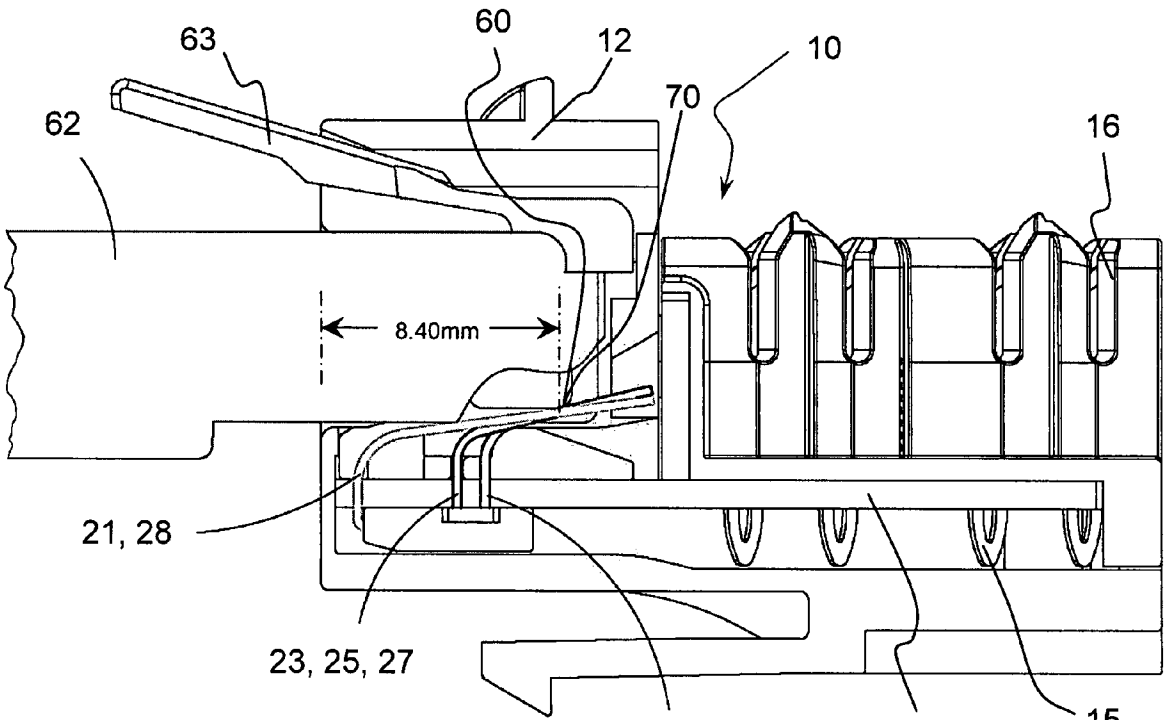
FIG. 3C is a partially sectional and cut side away view showing the jack assembly of FIG. 1 mated with an eight contact RJ plug.
Figures 4A, 4B, 4C, 5:
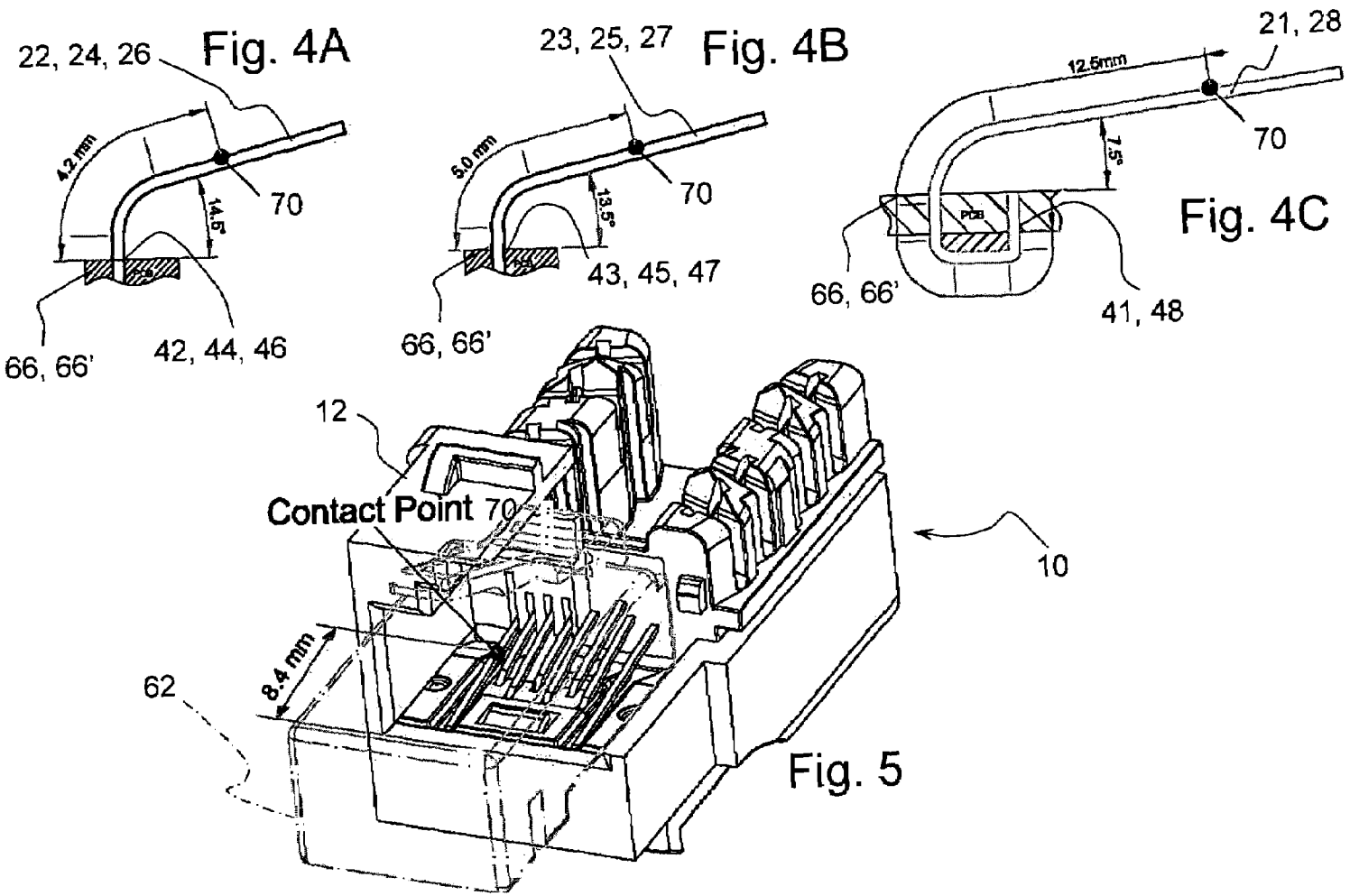
FIG. 4A is a sectional view through a circuit board showing a spring contact of a set of spring contacts and showing the signal path length from a contact area to a termination location on the printed circuit board.
FIG. 4B is a sectional view through the circuit board showing a spring contact of a set of spring contacts and showing the signal path length from a contact area to a termination location on the printed circuit board.
FIG. 4C is a sectional view through the circuit board showing a spring contact of a set of spring contacts and showing the signal path length from a contact area to a termination location on the printed circuit board.
FIG. 5 is a perspective view showing the jack assembly of FIG. 1 mated with an eight contact RJ plug shown in phantom line and showing a distance from the contact zone to the plane of the opening of the jack.

The spring contact conductors 21-28 in the embodiment shown are provided in sets having different geometries. The outermost spring contacts 21 and 28 have a geometry that is more similar to known spring contact geometries but is preferably a bit longer. Each of the outermost spring contacts 21 and 28 terminate at a circuit board 66 (see FIGS. 3A and 3C), and then extend upwardly and then rearwardly (with respect to the plane of the plug opening 18) to a contact point or contact area 70. As can be seen in FIGS. 4A, 4B and 4C, contacts 22, 24 and 26 have a shorter length and extend upwardly from the termination point (42, 44, 46) at the circuit board 66 and then extend rearwardly, at a different angle as compared to contacts 21 and 28. Contacts 23, 25 and 27 have a similar length to contacts 22, 24 and 26 but terminate (43, 45, 47) at the circuit board 66 rearwardly of the termination point of contacts 22, 24 and 26. The spring contact conductors 21-28 each terminate at the printed circuit board 66. The different geometries allow the spring contact conductors 22-27 to terminate at different spacings from the circuit board termination location (or from a plane of the opening 18) while still providing a contact in the contact area 70. With this arrangement the spring contact conductors 21-28 engage corresponding conductor contacts 60 of an RJ plug 62 when the RJ plug 62 is inserted into a contact position.

As shown in FIG. 3A-3D, the RJ plug 62 plug is inserted into the opening 18 to assume a contact position. In this contact position the plug contacts 60 extend a distance from the plane of the opening 18 to the contact position. The distance of the contacts 60 (and the contact area 70) from the plane of the opening 18, with the RJ plug 62 plug in the contact position, is somewhat standard (within a tolerance range) and about 8.4 mm. Typically the RJ plug 62 plug has a latch element 63 that engages a surface of the jack plastic cover part 12 and seats the plug in the contact position. This maintains the set distance of the contacts 60 (and the plug contact area 70) from the plane of the opening 18. The plug contact area 70 for each of the spring contact conductors 21-28 is at about the same distance from the plane of the opening 18, even though there are three different geometries of the sets of spring contact conductors 21-28. The different geometries of the spring contact conductors 21-28 also lower or prevent crosstalk coupling of adjacent spring contact conductors 21 the 28 in regions outside the plug contact area 70.

Figure 8:
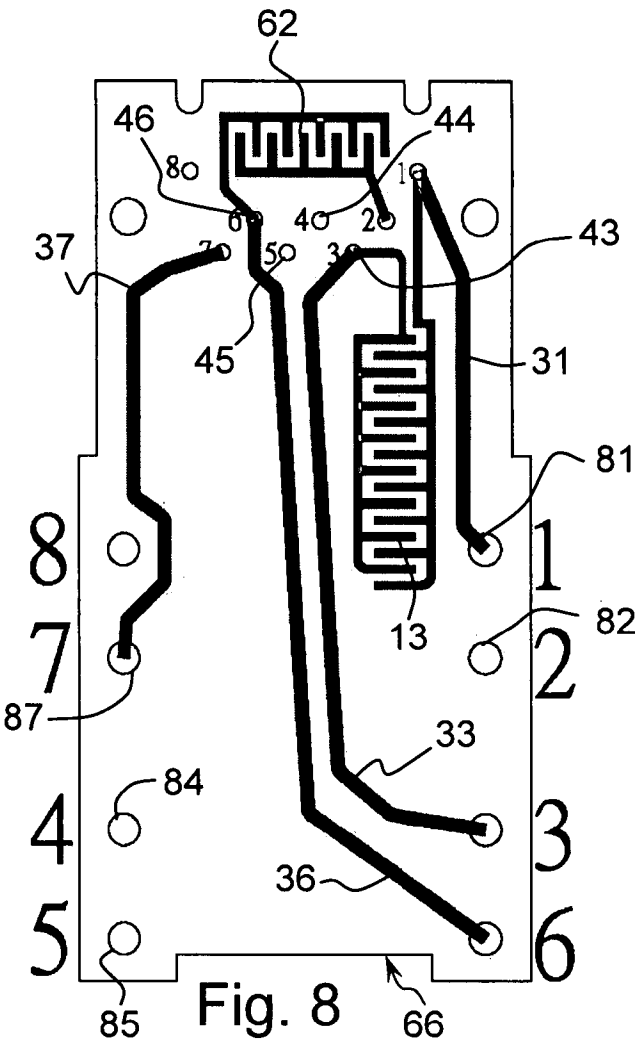
FIG. 8 is a view of a second side of a circuit board of FIG. 7.
Figure 7:
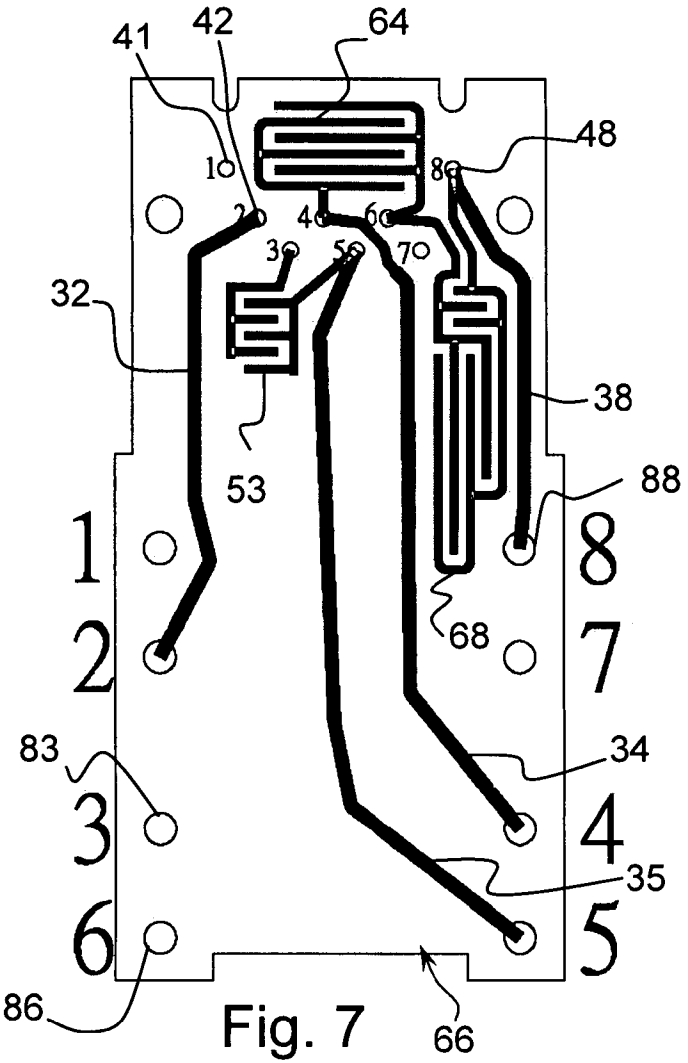
FIG. 7 is a view of a first side of a circuit board according to a first embodiment of the jack assembly of FIG. 1.

As can be seen in FIGS. 7 and 8 the respective termination location 41, 48 on the circuit board 66 for spring contact conductors 21 and 28 is much farther from contact area 70 and much closer to the plane of opening 18 as compared to the termination location for the spring contact conductors 22, 24, 26. The termination location along circuit board 66 for spring contact conductors 22, 24, 26 is closer to the plane of opening 18 as compared to the termination location for the spring contact conductors 23, 25 and 27. As such, these termination locations provide different distances or signal paths from the termination location (41-48) to the contact area 70 (different conductive path lengths).

The printed circuit board 66 (FIGS. 4 and 5) has plated through holes 41-48 receiving respective spring contact conductors 21-28 to form the termination locations. The IDCs 15 connect to circuit boards 66 via plated through holes 81-88. The plated through holes 41-48 are connected respectively to the respective plated through holes 81-88 via interconnecting conductors in the form of traces 31 through 38. The plated through holes 41-48, the plated through holes 81-88, and traces 31 through 38 continue the signal paths of the lines associated with spring contact conductors 21-28.

The jack assembly 10 is used to provide communication lines for high-performance communication applications. Such transmission lines each include a pair of signal paths. The signal paths in the example include a pair of signal paths 1, 2, a pair of signal paths 3, 6, a pair of signal paths 4, 5 and a pair of signal paths 7, 8. The signal paths 1, 2 are, in the region of the jack assembly 10, formed by the conductors including spring contact conductors 21, 22, plated through holes 41, 42, traces 31, 32 and IDC plated through holes 81, 82 and the connected IDCs 15. It can be seen that most of the signal paths of a pair for a line are adjacent to each other except for the region of signal paths 3, 6 involving the spring contact conductors 23 and 26. The spring contact conductors 23 and 26 are split, with spring contact conductors 24 and 25 being disposed between them. Spring contact conductors 25 and 24 are a center pair of conductors or center line conductors. Spring contact conductors 23 and 26 are a split pair of conductors or split line conductors. Crosstalk is problematic in this region with conductor 23 having conductor 22 from the 1,2 transmission line on one side and conductor 24 from the numeral 4, 5 transmission line on the other side. Conductor 26 has conductor 24 from the 4,5 transmission line on one side and conductor 27 from the 7, 8 transmission line on the other side.

Conductive traces are also provided that do not provide paths of the line. Instead, a (dead end) trace of one line interacts with a (dead end) trace of another line to form a capacitor (more particularly a reactive element having capacitive and inductive aspects) referred to herein as a crosstalk compensating element. FIG. 7 shows crosstalk compensating element 64 which includes traces connected to the termination location of spring contact conductor 24 and spring contact conductor 26. A compensating element 53 is provided which includes traces connected to the termination location of spring contact conductor 23 and spring contact conductor 25. Compensating element 53 introduces a compensating signal $v_2$ of a magnitude essentially equal to the magnitude of the crosstalk signal (noise signal) $v_1$ introduced between spring contact conductors 23 and 24 and the contact area 70. Compensating element 64 introduces a compensating signal $v_2$ of a magnitude essentially equal to the magnitude of the crosstalk signal (noise signal) $v_1$ introduced between the spring contact conductors 25 and 26 in the contact area 70.

Figure 6:
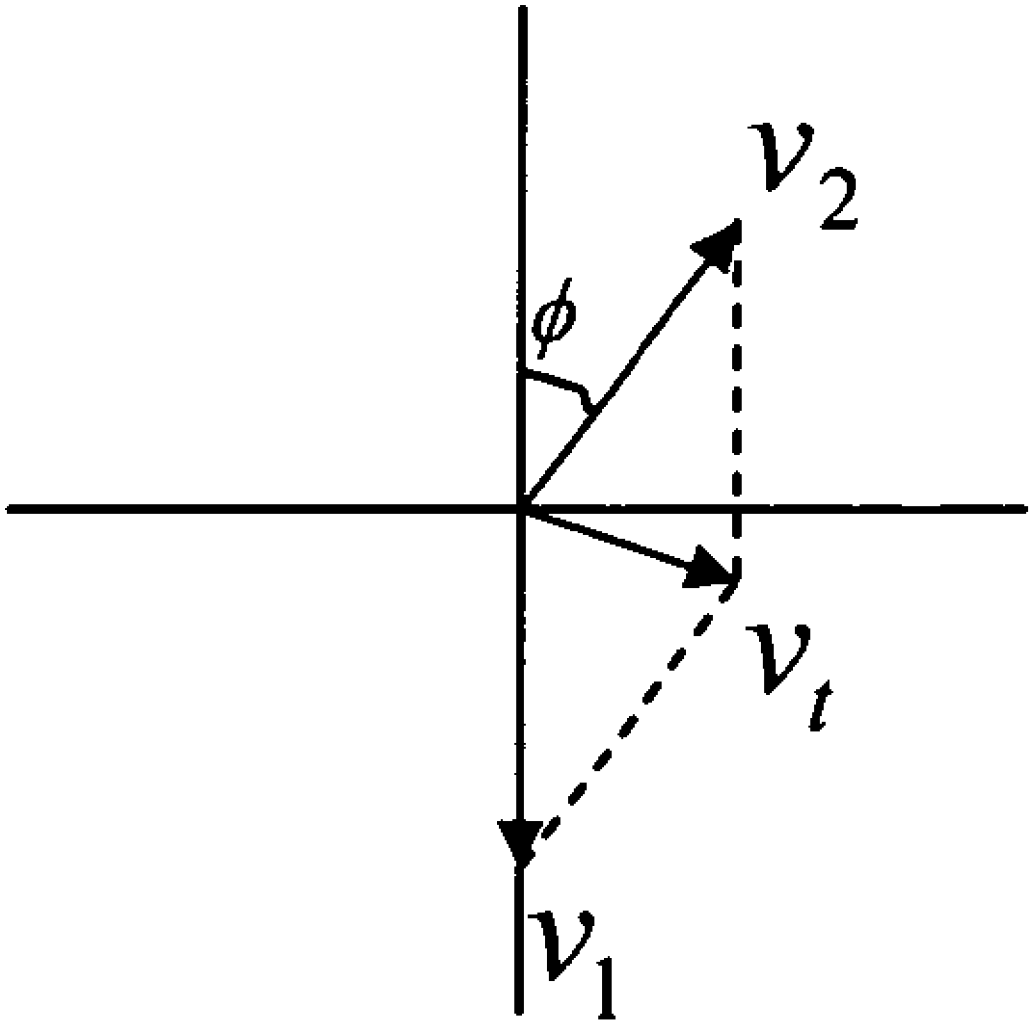
FIG. 6 is an explanatory diagram view from the complex plane illustrating aspects of crosstalk compensation for a first or only compensation phase of a first and second embodiment according to the invention.

As shown on the FIG. 6, to compensate the noise $v_1$, a signal $v_2$ is added a distance after (along the signal path) the point or region of application of $v_1$ (the contact region 70). Considering the view from the complex plane (FIG. 6), this distance will revel a phase delay denoted $\phi$ in FIG. 6. From FIG. 6 one can see that the vector sum of $v_1$ and $v_2$ will result in a vector $v_t$ with two components as follows:

$$v_{t\alpha}=v_2\sin\phi \quad \text{(Equation 1)}$$

$$v_{t\beta}=v_2\cos\phi-v_1 \quad \text{(Equation 2)}$$

the magnitude of vt is:

$$|v_t| = \sqrt{v_2^2\sin^2\phi + v_2^2\cos^2\phi - 2v_1 v_2\cos\phi + v_1^2} \quad \text{(Equation 3)}$$

Applicant has discovered that the minimum $v_t$ will happen at $$\frac{\partial v_t}{\partial v_2} = 0,$$

and that this will occur when $v_2=v_1 \cos\phi$. Hence:

$$|v_t|_{\text{minimum}} = v_1\sqrt{(1-\cos^2\phi)} \quad \text{(Equation 4)}$$

Though the required compensation vector can be calculated correctly, it is not possible to be manufactured without tolerance issues interfering. Given a 12.5% tolerance as a reasonable and attainable tolerance level $v_2=0.875v_1 \cos\phi$ or $v_2=1.125v_1 \cos\phi$ using $v_2=1.125v_1 \cos\phi$ one gets $$|v_t| = v_1\sqrt{(1-0.984\cos^2\phi)} \quad \text{(Equation 5)}$$

From eq.5 it is apparent that $v_t$ is almost proportional to cos $\phi$ and hence inversely proportional to the delay phase angle $\phi$. Considering the real world example of category 6 (CAT 6) connector hardware, according to TIA/EIA 568 B.2-1 one should have a $v_t$ of no more than −46 dB at 250 MHz. From the standard mentioned, one knows that $v_1$ should be −29 dB at 250 MHz between the center pair (24, 25) and the split pair (23, 26). Substituting these data into eq.5, one will have $$10\log(1-0.984\cos^2\phi)=-17.$$

A first embodiment of the invention limits the compensation to a single compensation signal (single compensating element) such that $\phi$ should not be more than 3.8 degrees. Otherwise, the resulting NEXT noise will not be acceptable (CAT 6 performance will not be attained). Applicant has also noticed that if the manufacturing tolerance is more than 14%, there is no apparent way to use a single compensation signal to reach the CAT6 performance requirements.

When considering the electromagnetic waves propagated in the transmission line made of copper, one can use a usual speed factor of 0.65. The wavelength at 250 MHz will be 0.78 meter. As such the physical length related to a 3.8 degree phase delay is 8.2 mm. However, because the compensation signal takes a round way trip in the transmission line (using first signal path and second signal path of a transmission line), the real distance between $v_1$ and $v_2$ (between the contact region and the compensation element connection region) is usually less than 4.1 mm. With a 10% manufacturing tolerance, that is at the boundary of today's manufacturing technical abilities, the performance may be attained with a longer 6.2 mm distance between $v_1$ and $v_2$ (between the contact region and the compensation element connection region). The jacks and jack assemblies 10 of the invention particularly provide a distance between contact point 70 of the plug and jack of one or more spring contact conductors 21-28 to the application point of the compensation signal that is less than 6.2 mm. The compensation signal is introduced or applied by one of the compensating elements (e.g., 35, 64) at a point such as the plated through hole 41-48 of the respective spring contact termination region.

FIG. 5 shows the terminated spring contact conductors 21-28, schematically illustrating the position of these conductors 21-28 in the contact state (the contact state is also shown in FIG. 3). FIG. 4A-4C show the lengths of the signal path from plug contact area 70 to termination location on the printed circuit board 66 (also 66'). From FIGS. 5 and 4A-4C it can be appreciated that the signal path length of the two sets of conductors 22, 24, 26 and 23, 25, 27 is shorter than the signal path length of a conductors 21 and 28. The shortened signal path length (including the length of the signal path through the curve) can be appreciated from FIGS. 4A-4C. The signal path length of a conductors 21 and 28 is preferably longer than prior jacks. The signal path length of a conductors 21 and 28 may also be shortened but this is not required to obtain the performance in the jack assembly according to the invention (crosstalk attenuation which must be reduced is significantly less than with the center conductors 24 and 25 and the split conductors 23 and 26). Particularly with the conductors 23, 24, 25 and 26 where crosstalk is more significant, the invention provides a shorter distance from the contact zone 70 to the termination location 43, 44, 45 and 46 of the respective conductors 23, 24, 25 and 26. Further, according to the invention, the compensation element 64 and compensation element 35 are applied to the termination location of the respective conductors 23, 24, 25 and 26. The signal path length of the respective conductors 23, 24, 25 and 26 is in each case less than 6.2 mm. In the preferred embodiment illustrated, the distance from plug contact area 70, of the plug 62 and jack 10 for conductors 23, 25 and 27, is 5 mm. In the preferred embodiment illustrated, the distance from plug contact area 70, of the plug 62 and jack 10 for conductors 22, 24 and 26 is 4.2 mm. The termination area positioned differently provides a different spacing, providing a different signal path length. Also, the different geometries of adjacent conductors allows a lower coupling of adjacent conductors (reduces the initial crosstalk signal $v_1$), thereby requiring a lower compensating signal $v_2$. Further, it is believed to be advantageous to provide equals path lengths for conductors 24 and 26 that are compensated by common compensating element 64. Likewise it is believed to be advantageous to provide equal path lengths for conductors 23 and 25 that are compensated by common compensating element 35. Further, as noted, it is unnecessary to provide a shortened signal path length for the outer conductors 21 and 28 (according to the disclosed embodiment). As such, the costs involved in providing the shorter and more precise conductors 22-27 can be avoided in the case of spring contact conductors 21 and 28.

The cross talk affecting the split pair line (with spring contact conductors 23 and 26) from the left line (spring contact conductors 27 and 28) and from the right line (spring contact conductors 21 and 22) is also compensated. The right side pair first spring contact conductor 21 does not significantly affect the split pair first spring contact conductor 23. However, the right side pair second spring contact conductor 22 is adjacent to the split pair first spring contact conductor 23 such that there is signal coupling. The left side pair first spring contact conductor 27 is adjacent to the split pair second spring contact conductor 26 such that there is signal coupling. A third crosstalk compensation element 13 is connected to the circuit board 66 providing crosstalk compensation between the right side (third) transmission line first signal path (21, 41, 31) and the second transmission line first signal path (23, 43, 33) as the only crosstalk compensation applied between the third transmission line first signal path and second transmission line first signal path. A fourth crosstalk compensation element 68 is connected to the circuit board 66 providing crosstalk compensation between the left side (fourth) transmission line second signal path (28, 48, 38) and the second transmission line second signal path (26, 46, 36) as the only crosstalk compensation applied between the fourth transmission line second signal path and the second transmission line second signal path. Further, better performance may be provided (although it is not essential) by providing an impedance balancing element 62.

To implement the single compensation system of the invention, the spring contacts 21-28 must still present the mechanical aspects required for a RJ 45 type connection. The allowable deflection of contact springs for a RJ 45 type connection must be taken into account.

A spring contact (21-28) of a RJ45 connector can be viewed as a cantilever beam. The relation between the deflection and the beam length of a cantilever beam can be summarized as follows.

$$\delta_{\max} = \frac{2\sigma_w l^2}{3Eh} \quad \text{(Equation 6)}$$

where $\delta_{max}$ is the allowable deflection without yield, $\rho_w$ is the allowable stress without yield, l is the distance between load and support, E is the Young's Modulus of the material, h is the height of the beam section.

Phosphorous copper is used for the spring contacts 21-28 as is commonly used for such electric connector springs. This has a value for E of about 110,000 N/mm$^2$. The value of $\rho_w$ is about 600 N/mm$^2$. A conventional RJ45 contact spring has a cross section of 0.35 mm in the height and 0.4 mm in the width. When these are substituted into equation 6, one is provided with the relation of $\delta_{max}$ to l as depicted in FIG. 9.

Figure 9:
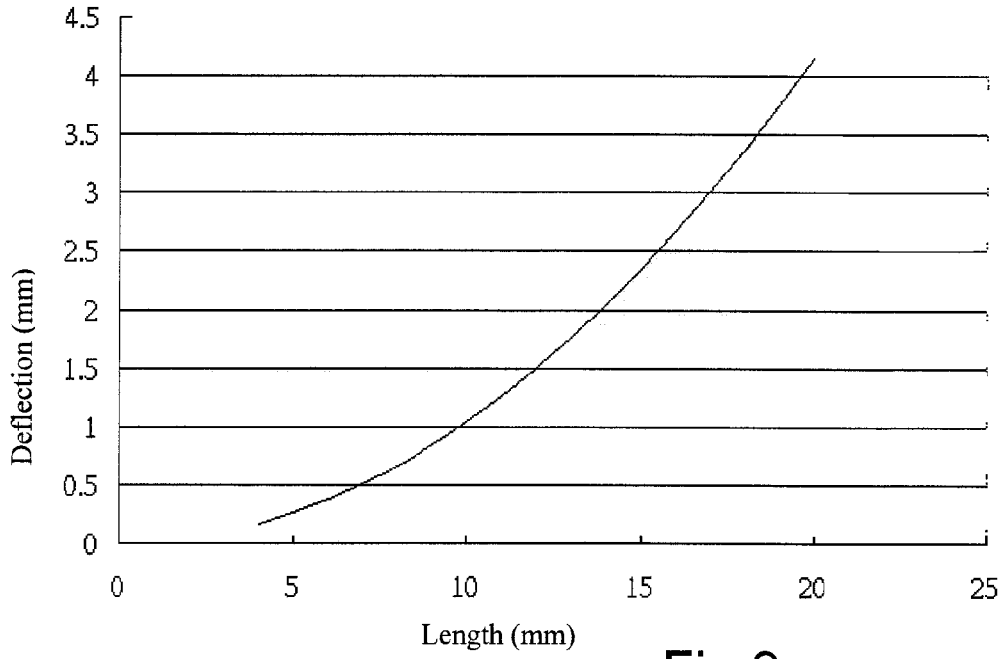
FIG. 9 is a view showing the normal relationship between spring contact deflection and spring contact length.

From FIG. 9, it can be appreciated that for the spring length less than 7 mm, the allowable deflection of the spring is less than 0.5 mm. The FCC Part68 requires a 0.3 mm tolerance for the deflection of the spring to cover the tolerance of heights of Plug blades. Manufacturing issues provide for another 0.3 mm deflection tolerance for production errors. To make the problem more complex, TIA/EIA 570 requires the RJ45 jacks to compatible with a 6 position RJ11 plug (see FIGS. 3A and 3B). It will add more 0.8 mm deflection for pin 1 and pin 8 of RJ45 jack. So, the minimum required deflection for a RJ45 contact spring is about 1.5 mm. It is clear from FIG. 9 that with a conventional spring design the spring length would be no less than 10 mm.

According to the invention, the single-compensation-method is carried out using spring contacts 22-27 that have a shortened length from the contact area 70 to the termination location (42-47), namely to the cross talk compensation element (in the form of a single compensation). However, as indicated above, to reach a higher performance for new performance requirements with a conventional design there is no way to shorten the length of the spring and fulfill the requirement of its deflection imposed by the FCC and TIA/EIA 570 as noted above. According to the invention, the performance requirements are met by providing spring contacts 22-27 that have a shortened length from the contact area 70 to the cross talk compensation element (in the form of a single compensation) whereas the spring contacts 21 and 28 (the pin 1 signal path and the pin 8 signal path) have a longer path as compared to the other contact springs (pins) 22-27. With this the deflection requirements of TIA/EIA 570 is only applied to spring contacts 21 and 28 (pin 1 and pin 8) and this is met with the longer spring contacts 21 and 28. Additionally, the spring contacts 22-27 have a thinner section as compared to the known cross section, namely with height of 0.3 mm (with minor tolerance variation) and a width of 0.4 mm (or less with minor tolerance variation). This makes sure that the deflection of spring is large enough. According to another implementation a cross section with a height of 0.2 mm is used and a width of 0.4 mm (or less with minor tolerance variation). When the height of the cross section is reduced, the contact force is also reduced. Accordingly, in some situations an insulated spring supporter 90 may be used to maintain the contact force.

Figure 10:
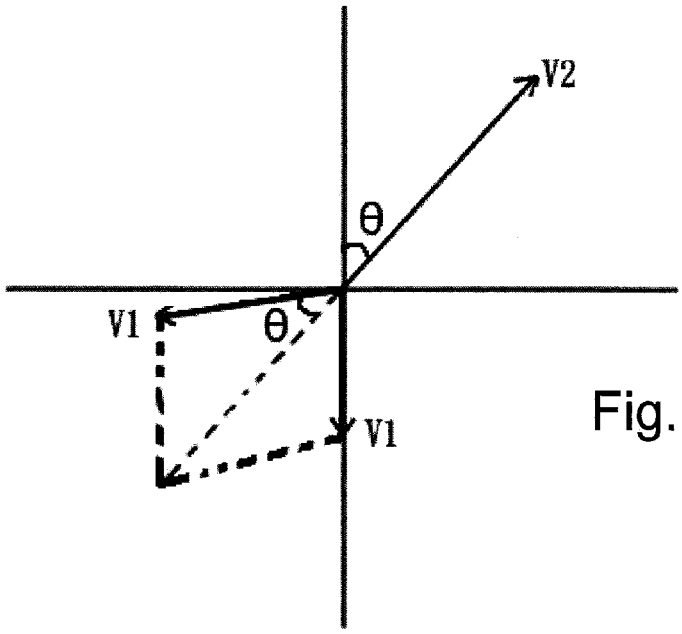
FIG. 10 is an explanatory diagram illustrating aspects of crosstalk compensation for first or and second compensation phases according to a second embodiment of the invention.

Another embodiment of the invention is described with reference to FIGS. 10 through 12. This connector 10 has a circuit board 66' that uses more than one compensation element for at least some of the paths (multi-phase compensation). Connector 10 presents hardware for 10 G performance through 500 MHz. To design a connector for high frequency and high performance, a well-known crosstalk compensation scheme called multi-phase compensation can be used, providing a compensation phase between the same lines, in addition to the first phase, the technique discussed above. But, if the frequency band is too wide (so as to provide high throughput-bandwidth), the time delay of the compensation will make it difficult to balance the performances at both ends of the frequency band. The techniques as to spring contact length and termination relative to the contact zone 70 is also used for the first phase in the second embodiment for 10 G performance and at least one second phase is also provided.

If $V_1$ is a vector representing the Near-End-Cross-Talk (NEXT) of the plug/jack, to compensate the noise (crosstalk), the well-known multi-phase compensation technique adds first compensation at some location after the crosstalk introduction point (in the vicinity of contact are 70) as an opposite signal vector $V_2$. The signal $V_2$ has a magnitude that is about double the magnitude of the signal $V_1$. Then a vector with the same polarity (involving the interaction of the same signal paths as the initial crosstalk noise) and magnitude of $V_1$ is added the same distance after $V_2$ to balance the time delay effect of $V_2$. FIG. 10 depicts the concept. One may calculate the vector sum as:

$$V_x = V_2 \sin\theta - V_1 \sin 2\theta,$$

$$V_y = V_2 \cos\theta - V_1(1+\cos 2\theta)$$

with the above, the residual vector may be calculated as $$V_{res} = \sqrt{V_x^2 + V_y^2} = V_2 - 2V_1 \cos\theta \quad \text{(Equation 7).}$$

The rule of thumb is to make the residual vector $V_{res}$ zero at the middle of the bandwidth so that the performance will be symmetrically balanced for both ends. The frequency where the NEXT is made zero is called tuned frequency. Hence, one knows that at the tuned frequency $$V_2 = 2V_1 \cos\theta_t$$

With this, one will get the residual noise of any frequency where the subscript t represents tuned. Substituting $v_2$ into equation 7 provides the residual noise associated with any frequency.

$$V_{res} = 2V_1(\cos\theta_t - \cos\theta) \quad \text{(Equation 8)}$$

To reduce the complexity of the cosine function, one takes the Taylor's series $$\cos x = 1 - \frac{x^2}{2!} + \frac{x^4}{4!} - \dots .$$

Since both $\theta$ and $\theta_t$ are far smaller than 1, one may omit the high order items without loss of accuracy. Now, $$\theta = \frac{2\pi l f}{v}$$

Where l is the length that the signal traveled and is equal to double of the distance between $V_1$ and $V_2$. The v is the signal transmission speed and f is the frequency. Substituting the above items into equation 8 one will get $$V_{res} = 4\pi^2 l^2 V_1 * \left| \frac{f^2 - f_t^2}{v^2} \right| \quad \text{(Equation 9)}$$

From equation 9, it is clear that at the end of the bandwidth the residual noise $V_{res}$ is proportional to the square of l, hence the square of the distance, and the half of the bandwidth $|f^2-f_t^2|$, when $f=f_t$, $V_{res}=0$.

Manufacturing tolerances may next be considered. In order to make the calculation easier to understand, an error may be assigned to the original vector.

$$V_x = V_2 \sin\theta - V_1 \sin 2\theta \quad \text{(Equation 10)}$$

$$V_y = V_2 \cos\theta - tV_1(1 + \cos 2\theta),$$

where $t$ is the tolerance factor.

$$V_{res} = V_1 \sqrt{\begin{array}{c} 4(\cos_t\theta - \cos\theta)^2 - \\ 4(t-1)\cos\theta(\cos\theta_t - \cos\theta) + (t-1)^2 \end{array}}$$

The Taylor's series of the cosine function results in $$\cos\theta_t - \cos\theta = 2\pi^2\left(\frac{f^2 - f_t^2}{v^2}\right)l^2$$

and $$\cos\theta = 1 - 2\pi^2 l^2\left(\frac{f^2}{v^2}\right)$$

Letting $$A=4(\cos_t\theta-\cos\theta)^2-4(t-1)\cos\theta(\cos\theta_t-\cos\theta)+(t-1)^2$$

one can substitute the cosine series into A and from equation 10 one gets $$A = \left(\frac{2\pi}{v}\right)^4 (f^2 - f_t^2)(tf^2 - f_t^2)l^4 - 2(t-1)\left(\frac{2\pi}{v}\right)^2 (f^2 - f_t^2)l^2 + (t-1)^2 \quad \text{(Equation 11)}$$

and $$20\log_{10}V_{res}=20\log_{10}V_1+10\log_{10}A \quad \text{(Equation 12)}$$

Taking into consideration real world factors, TIA/EIA defines an augmented CAT6 cabling category for 10 G Ethernet application that operates from 1 MHz through 500 MHz. A reasonable tuning frequency is 250 MHz. Considering the residual noise of the lower end, 10 MHz is the lowest frequency that TIA/EIA has defined as a test plug value. Taking a central test plug of the line 3, 6 pair and the line 4, 5 pair combination, the $V_1$ is −57 dB from the de-embedded measurement. The allowable residual noise is −74 dB by the TIA/EIA 568B.2-1 standard. When one substitutes this limit into equation 11, one gets A that must be no larger than 0.02. If one then assumes a tolerance factor t=1.13, which approximates the normal tolerance of 12.5%, and a normal transmission velocity v=2.0e8, from equation 10, one has $3792l^2+16l^2-0.03 \leqq 0$. This results in $l \leqq 13.4$, and the distance between $V_1$ and $V_2$ has to be less than 6.7 mm, namely the distance from contact zone 70 to the termination location, which is the distance from the crosstalk signal to the location the first compensation.

Figure 12:
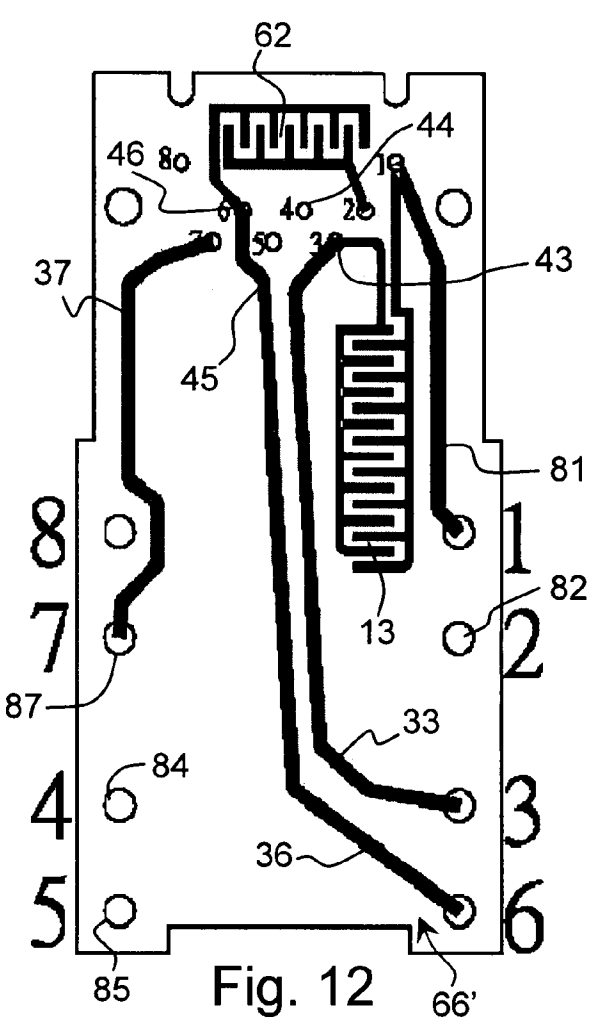
FIG. 12 is a view of a second side of a circuit board of FIG. 11.
Figure 11:
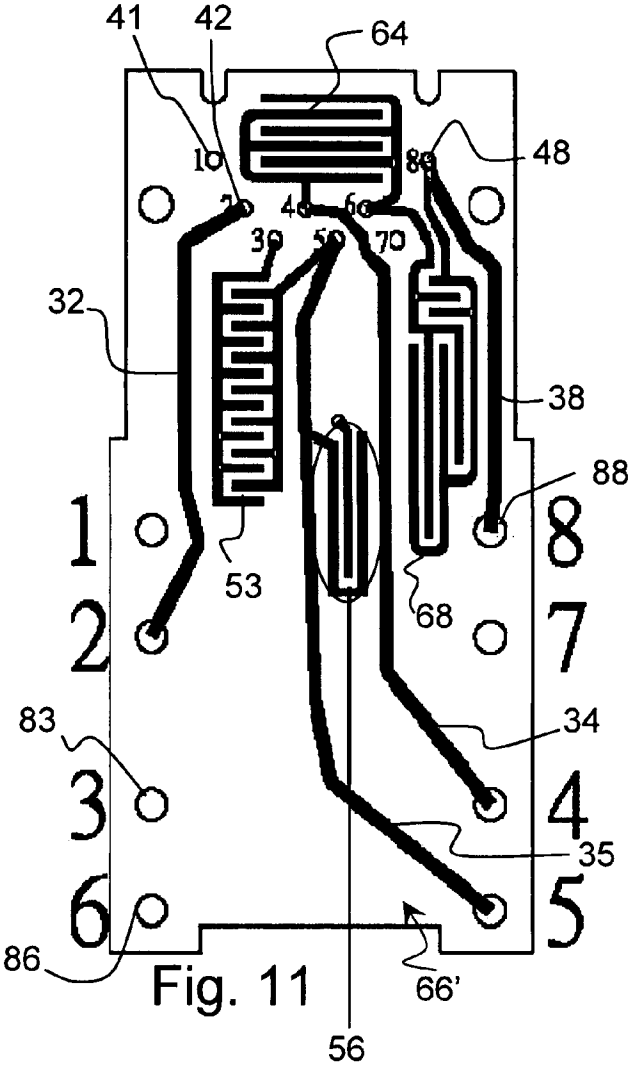
FIG. 11 is a view of a first side of a circuit board of the second embodiment of the jack assembly of FIG. 1.

Referring to FIGS. 11 and 12, a circuit board 66' is shown that is deployed in the same manner as the circuit board 66 described above. Particularly, the circuit board 66' of the second embodiment is connected with a plastic part 14 having slots 16 for insulation displacement contacts 15 and with a plastic cover part 12 (see FIGS. 1 and 2). The circuit board 66' has spring contact conductors 21 through 28 that are terminated (connected to the circuit board traces) at termination locations 41 through 48 respectively. The termination locations are particularly plated through holes or using some other technique for connecting the spring contact to the traces of the circuit board.

With higher throughput applications (10 G) using a jack assembly 10, a circuit board such as 66' is used where communications are still based on multiple communication lines or transmission lines with each line based on a pair of signal paths. In FIGS. 10 and 11 the signal paths (beginning and end of such paths carried by the circuit traces 31-38 on the circuit board 66') are labeled one (1) through eight (8). The termination locations 41 through 48 are connected with the respective interconnecting conductors or traces 31 through 38. The traces 31 through 38 continue the signal paths 1 through 8 of the transmission lines. Up to four transmission lines with paths 1 through 8 are associated with the spring contact conductors 21-28 through plated through holes or termination locations 41-48, traces 31 through 38 to plated through holes or termination locations 81-88 and respective insulation displacement contacts 15.

The signal paths 1 and 2 are the outer left side transmission line and include the spring contacts 21 and 22, plated through holes 41 and 42, and 28, plated through holes 47 and 48, traces 37 and 38 are connected to respective IDCs 15 by plated through holes 87 and 88. The signal paths 4 and 5 are the center transmission line and include the spring contacts 24 and 25, plated through holes 44 and 45, and traces 34 and 35 connected to respective IDCs 15 by plated through holes 84 and 85. The signal paths 3 and 6 are the split pair transmission line and include the spring contacts 23 and 26, plated through holes 43 and 46, and traces 33 and 36 connected to respective IDCs 15 by plated through holes 83 and 86.

The second embodiment of the invention compensates for crosstalk using what is sometimes referred to as multiphase compensation. A first compensation phase is provided with capacitors (reactive elements—compensation elements) such as 64 and 53 that introduce a signal from the signal paths not originally affected by the crosstalk that occurred near or at the plug contact area 70. The first compensation phase introduces a compensating signal $V_2$. Where a second phase is applied (a second phase is not applied for each line and the center line and split pair line may have an uneven phase delay as noted) the signal $V_2$. Is about twice the magnitude of the original crosstalk signal. If no second phase is applied between the lines, the single phase compensating signal of about the same value is introduced as noted above. The second phase of compensation reintroduces $V_1$ preferably at about the same spacing of $V_2$ from the original crosstalk value $V_1$. Because the compensation elements 64 and 53 are applied close to or at the termination locations 44, 46, 45, 43 and based on the spring contact configuration of spring contacts 21-28, $V_2$ or single phase (opposite but equal to the value of $V_1$) is introduced into the signal paths less than 6.7 or 6.2 mm from the contact zone 70. A crosstalk compensation element (capacitor) 13 is connected to the circuit board 66 providing crosstalk compensation by applying the compensating signal between paths 1 and 3. This compensation element 13 is the only phase or first phase (but for different lines). As with the first embodiment an impedance balancing element 62 may be provided.

To achieve greater bandwidth (higher throughput) at least one other compensation element 56 is provided introducing a compensating signal corresponding to $V_1$ which is based on interaction between the signal paths 5 and 6, signal paths originally affected by the crosstalk $V_1$ that occurred near or at the plug contact area 70. Compensation element 56 is connected in the range of 6.2 to 7.2 mm such as around 6.7 mm from the termination locations 45, 46 providing advantages based on the application of compensating signal $V_2$ relative to compensating signal $V_1$ as noted above. As for the implementation of multiphase compensation, two even phase delays may be employed between the three signal vectors, (i.e. the original (crosstalk), the 1 st compensation, and the 2nd compensation). In the preferred implementation an uneven phase delay is used to separate those signal vectors as only one set of paths has a second phase. Also, due to that the phase delay between the 1st compensation vector (compensating signal $V_1$) and the original (crosstalk) vector being reduced, the required balance compensation, (2nd compensation), is tiny. The final result should be little affected by the phase delay error of this tiny signal. As such, the compensation element 56 may also be applied so as to provide a larger phase delay and hence a smaller compensation magnitude. With this, and considering the area required by compensation circuits, the 2nd compensation (the compensation element 56) may be far away from the 1 st compensation (64, 53). For example with $V_2$ (the first compensation phase) applied by the compensation elements 64 and 53 at less than 6.7 mm from the original crosstalk ($V_1$), the 2nd compensation in the form of the compensation element 56 deployed as an uneven phase delay may be connected to termination locations 85, 86 to provide good 10 G performance (TIA/EIA augmented CAT6 cabling category for 10 G Ethernet application that operate from 1 MHz through 500 MHz).

While specific embodiments of the invention have been shown and described in detail to illustrate the application of the principles of the invention, it will be understood that the invention may be embodied otherwise without departing from such principles.

What is claimed is:

1. An electrical connector jack comprising:

a body with a support portion and a plug receiving portion defining an opening with an insertion plane;

a circuit board mounted to said support portion to position said circuit board relative to said plug receiving portion and said insertion plane, said circuit board having circuit traces respectively extending from spring contact termination locations, said spring contact termination locations including a first set of spring contact termination locations spaced a first distance from said insertion plane, a second set of spring contact termination locations spaced a second distance from said insertion plane and a third set of spring contact termination locations spaced a third distance from said insertion plane;

a plurality of spring contact conductors each terminating at a respective one of said spring contact termination locations, each of said spring contact conductors having a common plug contact zone spaced substantially at a common distance from said insertion plane wherein each of said spring contact conductors provides a conductive path from said plug contact zone to a respective said spring contact termination location and said spring contact conductors include a first set of spring contact conductors that are each connected to said first set of spring contact termination locations to each define a first conductive path length from a respective said first set of spring contact termination locations to said plug contact zone that is 7 mm or less and a second set of spring contact conductors that are each connected to said second set of spring contact termination locations to each define a second conductive path length from a respective said second set of spring contact termination locations to said plug contact zone that is 7 mm or less; and a crosstalk compensation element defined on said circuit board and connected to at least one of said first set of spring contact conductors at a respective one of said first set of spring contact termination locations to provide an application location of said crosstalk compensation element less than 7 mm from said plug contact zone and a crosstalk compensation element connected to at least one of said second set of spring contact conductors at a respective one of said second set of spring contact termination locations to provide an application location of said crosstalk compensation element less than 7 mm from said plug contact zone, wherein said first conductive path length is between 4 and 5 mm and said second conductive path length is between 4.5 mm and 5.5 mm and said spring contact conductors connected to said third set of spring contact termination locations have a conductive path length that is 10 mm or greater.

2. An electrical connector jack according to claim 1, wherein spring contact conductors connected to said first set of spring contact termination locations and said second set of spring contact termination locations have a cross section with height of less than 0.35 mm or less and a width of 0.4 mm or less.

3. An electrical connector jack according to claim 1, wherein each of said spring contact conductors provides a conductive path from said plug contact zone to a respective said spring contact termination location and spring contact conductors connected to said first set of spring contact termination locations and said second set of spring contact termination locations have a minimum deflection less than 1.5 mm and spring contact conductors connected to said third set of spring contact termination locations have a minimum deflection of at least 1.5 mm.

4. An electrical connector jack according to claim 1, wherein each of said spring contact conductors provides a conductive path from a plug contact zone to a respective said spring contact termination location and three spring contact conductors are connected to said first set of spring contact termination locations and three said spring contact conductors are connected to said second set of spring contact termination locations with spring contact conductors connected to said first set of spring contact termination locations alternating with spring contact conductors connected to said second set of spring contact termination locations to provide contacts of alternating termination and two spring contact conductors are connected to said third set of spring contact termination locations with one of said spring contact conductors connected to said third set of spring contact termination locations extending on one side of said contacts of alternating termination and another of said spring contact conductors connected to said third set of spring contact termination locations extending on another side of said contacts of alternating termination.

5. An electrical connector jack according to claim 4, wherein a cross section of said contacts of alternating termination is smaller than a cross section of said spring contact conductors connected to said third set of spring contact termination locations.

6. An electrical connector comprising:

a circuit board with interconnecting conductors respectively extending between spring contact termination locations and other termination locations;

a set of spring contact conductors each terminating at a respective one of said spring contact termination locations, each spring contact conductor of said set of spring contact conductors having a plug contact in which said spring contact conductor deflects upon contact with a plug, each of said spring contact conductors having an allowable deflection associated with a length thereof and said length of each of said spring contact conductors defining a spring contact conductive path from an associated said plug contact zone to a respective said spring contact termination location that is 6.7 mm or less, wherein pairs of interconnecting conductors and electrically connected spring contact conductors form part of transmission lines and further comprising: a first/second crosstalk compensation element providing a first/second crosstalk compensation signal between a first interconnecting conductor of one line and a second interconnecting conductor of another line and a second/first crosstalk compensation element providing a second/first crosstalk compensation signal between a second interconnecting conductor of said one line and a first interconnecting conductor of said another line, with each crosstalk compensation element being on said circuit board applied at or closely adjacent to said termination location.

7. An electrical connector according to claim 6, further comprising:

a second set of spring contact conductors each terminating at a respective one of said spring contact termination locations, said second set of spring contact conductors including a right outside spring contact conductor on a right side of said set of spring contact conductors and left outside spring contact conductor on a left side of said set of spring contact conductors, said second set of spring contact conductors each having a plug contact zone in which said spring contact conductor deflects upon contact with the plug, each of said second set of spring contact conductors having an allowable deflection associated with a length thereof and said length of each of said spring contact conductors defining a spring contact conductive path from an associated said plug contact zone to a respective said spring contact termination location that is 10 mm or greater.

8. An electrical connector according to claim 6, wherein said spring contact termination locations are offset with adjacent spring contact termination locations such that a conductive path of an associated spring contact conductor is different from a conductive path of an adjacent spring contact conductor with some of said set of spring contact conductors having a spring contact conductive path that is from 5.0 mm to 6.2 mm and some of said set of spring contact conductors having a spring contact conductive path that is from 4.2 mm to 6.0 mm.

9. An electrical connector according to claim 6, wherein said first/second crosstalk compensation element and said second/first crosstalk compensation element are the only compensation element connected between said first line and said second line on said circuit board.

10. An electrical connector according to claim 6, further comprising another crosstalk compensation element providing a second phase crosstalk compensation signal between an interconnecting conductor of said one line and an interconnecting conductor of said second line.

11. An electrical connector according to claim 10, wherein said another crosstalk compensation element providing a further crosstalk compensation signal is applied less than 7.2 mm from a termination location of the interconnecting conductor of said one line and the interconnecting conductor of said second line.

12. An electrical connector according to claim 10, wherein said another crosstalk compensation element providing a further crosstalk compensation signal is applied at two of said other termination locations.

13. A connector jack, comprising:

a plurality of spring contact conductors providing conductor pairs for plural transmission lines defining a RJ plug contact area with crosstalk of a magnitude between a transmission line with a center pair of spring contact conductors and another transmission line with a pair of spring contact conductors including a first side spring contact conductor on a first side of said center pair and a second side spring contact conductor on a second side of said center pair, each of said spring contact conductors being mounted for deflecting upon contact in said RJ plug contact area with a RJ plug;

a circuit board;

interconnecting conductors mounted on said circuit board and connected to said spring contact conductors to provide conductive paths for each of said lines, wherein said interconnecting conductors comprise traces on a circuit board with plated through holes providing electrical connection between one of said traces and a corresponding one of said inner spring contact conductors and each said conductive path including a spring contact conductive path based on a length of the respective mounted inner spring contact conductor from a respective one of said plated through holes to a respective RJ plug contact area and having an allowable deflection associated with said length;

crosstalk compensation means connected between said line with center pair conductors and said another line with another pair of conductors, said crosstalk compensation means being applied to one of said interconnecting conductors and said spring contact conductors at a location along said path that is not greater than 6.2 mm from said contact area, said crosstalk compensation means being mounted on said circuit board; and a plurality of outermost spring contact conductors defining outer RJ plug contact areas, each of said outermost spring contact conductors being mounted to a respective one of said plated through holes for deflecting upon contact in said RJ plug contact area with a RJ plug, respective interconnecting conductors being connected to said inner spring contacts to provide a conductive path for each of said lines, said interconnecting conductors including traces and plated through holes providing electrical connection between a trace and a corresponding one of said outermost spring contact conductors, each outermost spring contact conductor having a conductive path based on a length of 10 mm or more of the respective mounted outermost spring contact conductor from a respective one of said plated through holes to a respective RJ plug contact area and having an allowable deflection associated with said length of 10 mm or more, wherein said crosstalk compensation means comprises a trace on said circuit board connected to said line with center pair conductors and a trace on said circuit board connected to said another line, wherein said crosstalk compensation means is connected to said plated through holes to apply said crosstalk compensation adjacent to an interface between one of said traces and a corresponding one of said plated through holes.

14. A connector jack according to claim 13, wherein a distance of said contact area of said center pair conductors or said another pair of conductors to an associated plated through hole is 5.2 mm or less.

15. A connector jack according to claim 13, further comprising:

plural insulation displacement contacts each terminated to a respective one of said interconnecting conductors;

a body cooperating with said insulation displacement contacts to form wire receiving slots for terminating wires to said insulation displacement contacts.

* * * * *